US009227411B2

(12) United States Patent
Okayama et al.

(10) Patent No.: US 9,227,411 B2
(45) Date of Patent: Jan. 5, 2016

(54) NOZZLE FACE CLEANING DEVICE AND IMAGE RECORDING DEVICE

(71) Applicant: FUJIFILM Corporation, Tokyo (JP)

(72) Inventors: Yoshiyuki Okayama, Ashigarakami-gun (JP); Noboru Kinomoto, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/592,193

(22) Filed: Jan. 8, 2015

(65) Prior Publication Data

US 2015/0116423 A1 Apr. 30, 2015

Related U.S. Application Data

(63) Continuation of application No. PCT/JP2013/068720, filed on Jul. 9, 2013.

(30) Foreign Application Priority Data

Jul. 11, 2012 (JP) ..... 2012-155538

(51) Int. Cl.
*B41J 2/165* (2006.01)

(52) U.S. Cl.
CPC ..... *B41J 2/16535* (2013.01); *B41J 2/16552* (2013.01); *B41J 2/16585* (2013.01); *B41J 2002/1655* (2013.01); *B41J 2002/16558* (2013.01)

(58) Field of Classification Search
CPC ..... B41J 2/16538; B41J 2/16535; B41J 2/16585; B41J 2/16547; B41J 2/16541
USPC ..... 347/33, 29, 31, 32
See application file for complete search history.

(56) References Cited

U.S. PATENT DOCUMENTS

| | | | | |
|---|---|---|---|---|
| 2004/0218002 | A1 | 11/2004 | Nakamura | |
| 2010/0245466 | A1* | 9/2010 | Inoue | 347/30 |
| 2011/0074870 | A1* | 3/2011 | Maida | 347/28 |
| 2012/0038707 | A1* | 2/2012 | Maida | 347/33 |

FOREIGN PATENT DOCUMENTS

| | | | |
|---|---|---|---|
| JP | 3041876 | U | 10/1997 |
| JP | 2004-195908 | A | 7/2004 |
| JP | 2009-286077 | A | 12/2009 |
| JP | 2009-297951 | A | 12/2009 |
| JP | 2010-280067 | A | 12/2009 |
| JP | 2011-073339 | A | 4/2011 |
| JP | 2012-040693 | A | 3/2012 |

OTHER PUBLICATIONS

International Search Report; PCT/JP2013/068720; Sep. 17, 2013.

* cited by examiner

*Primary Examiner* — Manish S Shah
*Assistant Examiner* — Yaovi Ameh
(74) *Attorney, Agent, or Firm* — Studebaker & Brackett PC

(57) ABSTRACT

A nozzle face cleaning device and an image recording device includes: a wiping member; cleaning liquid adding means which adds a cleaning liquid to the wiping member; pressing means that brings the wiping member to which the cleaning liquid has been added, into pressure-contact with a nozzle face; and wiping means which makes the wiping member and an ejection head relatively move, and wipes the nozzle face. A cleaning liquid supply flow channel is opened to the air in a connected portion of the cleaning liquid supply flow channel and a cleaning liquid adding nozzle.

11 Claims, 12 Drawing Sheets

NOZZLE FACE CLEANING DEVICE AND IMAGE RECORDING DEVICE

CROSS-REFERENCE TO RELATED APPLICATIONS

This application is a Continuation of PCT International Application No. PCT/JP2013/068720 filed on Jul. 9, 2013, which claims priority under 35 U.S.C. §119(a) to Japanese Patent Application No. 2012-155538 filed on Jul. 11, 2012. Each of the above applications is hereby expressly incorporated by reference, in their entirety, into the present application.

BACKGROUND OF THE INVENTION

1. Field of the Invention

The present invention relates to a nozzle face cleaning device and an image recording device, and particularly to a nozzle face cleaning device and an image recording device which bring a wiping member to which a cleaning liquid has been added into contact with a nozzle face and wipes a nozzle face.

2. Description of the Related Art

Onto a nozzle face of an ink jet head which is used in an image recording device, for instance, an ink jet recording device, various foreign substances such as a residue of ink and paper powder are deposited due to service. When a foreign substance is deposited on the nozzle face, an ink droplet which is ejected from a nozzle is affected by the deposited foreign substance, thereby dispersion occurs in an ejection direction of ink droplets, and it becomes difficult to land the ink droplet at a predetermined position on a recording medium. The deposition of the foreign substance onto the nozzle face causes a deterioration of an image quality. Then, it becomes important in the ink jet recording device to remove the foreign substance with a maintenance method of periodical wiping or the like.

In the following Japanese Patent Application Laid-Open No. 2010-280067 (Patent Literature 1), for instance, a droplet ejecting device is described which has a structure of supplying a cleaning liquid to a wiping member, and wiping an ejection portion of an ejection head with the wiping member. In addition, Japanese Patent Application Laid-Open No. 2004-195908 (Patent Literature 2) describes a technology of ejecting a cleaning liquid onto a wiping sheet, pressing the wiping sheet to a nozzle face, and thereby wiping the nozzle face.

SUMMARY OF THE INVENTION

However, devices described in Patent Literatures 1 and 2 send a compressed air to a tank, supply the cleaning liquid to the wiping member with a spray nozzle or the like, and wipe the nozzle face with the wiping member. However, the spray nozzle and the like need to be replaced, and when a cleaning liquid supply tube is attached to and detached from the spray nozzle, air bubbles are mixed into the nozzle and the tube. There has been such a problem, for instance, that it becomes difficult in the early time of replacement to adjust the amount of the cleaning liquid, which has remarkably lowered the operability. In addition, when the wiping member is replaced, the spray nozzle needs to be detached. After the wiping member has been replaced, the position of the spray nozzle needs to be adjusted, and also from this point, the lowering of the operability has been shown.

The present invention is designed with respect to such circumstances, and an object is to provide a nozzle face cleaning device and an image recording device which can reduce mixing of air bubbles into a cleaning liquid supply flow channel, facilitate replacement of a web, and consequently can enhance operability.

In order to achieve the above described objects, the present invention provides a nozzle face cleaning device configured to clean a nozzle face of an ejection head which includes: a wiping member which has a long shape and water absorbing properties; cleaning liquid adding means configured to add a cleaning liquid to the wiping member, to bring the wiping member to a wet state by the cleaning liquid in an amount suitable for wiping the ejection head; pressing means configured to make the wiping member to which the cleaning liquid has been added abut on and pressed against the nozzle face; and wiping means that has wiping member travel driving means configured to make the wiping member travel in a longitudinal direction along a predetermined conveyance path, the wiping means configured to wipe the nozzle face with the wiping member to which the cleaning liquid has been added, by relatively moving the wiping member and the ejection head so that the wiping member which has been made abut on and pressed against the nozzle face slides along the nozzle face while being travelled by the wiping member travel driving means, wherein the cleaning liquid adding means includes a cleaning liquid supply flow channel, and a cleaning liquid adding nozzle which is detachably connected to the cleaning liquid supply flow channel and adds the cleaning liquid to the wiping member therethrough, wherein the cleaning liquid adding nozzle is provided in a case in which the wiping member, the wiping member travel driving means and the pressing means are integrated, and the cleaning liquid supply flow channel is opened to the air in a connected portion of the cleaning liquid supply flow channel with the cleaning liquid adding nozzle.

According to the present invention, the cleaning liquid supply flow channel and the cleaning liquid adding nozzle are included as the cleaning liquid adding means, wherein the cleaning liquid supply flow channel is opened to the air and is connected to a cleaning liquid supply nozzle. The nozzle face cleaning device supplies the cleaning liquid from the cleaning liquid supply flow channel to the cleaning liquid supply nozzle, by opening the flow channels to the air, dividing the flow channels and passing the cleaning liquid in the flow channels. Because of this, when the cleaning liquid supply nozzle is replaced, the air bubbles are not mixed in the cleaning liquid. Accordingly, the cleaning liquid supply nozzle can be easily replaced, and the amount of the cleaning liquid in the early time of the replacement can also be easily adjusted.

In addition, the cleaning liquid adding nozzle is provided in the case in which the wiping member, the wiping member travel driving means and the pressing means are integrated, and even when the cleaning liquid supply flow channel has been detached from the cleaning liquid adding nozzle, the cleaning liquid adding nozzle can be kept at a predetermined position. Accordingly, even when the cleaning liquid adding nozzle and the cleaning liquid supply flow channel are connected to each other again, the cleaning liquid adding nozzle does not need to be positioned. Furthermore, also when the wiping member is replaced, the cleaning liquid adding nozzle is fixed, even when the wiping member has been detached. Accordingly, the cleaning liquid adding nozzle does not need to be positioned, and the operability can be enhanced.

In the nozzle face cleaning device according to other aspect of the present invention, it is preferable that a position at which the cleaning liquid is added to the wiping member from the cleaning liquid adding nozzle is provided in the upper side in a vertical direction of the wiping member, and that the cleaning liquid is added to the wiping member by the dripping of the cleaning liquid from the cleaning liquid adding nozzle.

The nozzle face cleaning device according to the other aspect of the present invention can supply the cleaning liquid by dripping the cleaning liquid onto the wiping member from the cleaning liquid supply nozzle. Accordingly, the nozzle face cleaning device can reliably add the cleaning liquid to a predetermined position, and accordingly can reduce the amount of the cleaning liquid. When the spray nozzle is used, the cleaning liquid is not occasionally added to the predetermined position, and there has been a large amount of a waste cleaning liquid, but in the present embodiment, the amount of the cleaning liquid can be reduced.

It is preferable that the nozzle face cleaning device according to other aspect of the present invention has a cutout portion in a portion at which the cleaning liquid supply flow channel is opened to the air.

The nozzle face cleaning device according to the other aspect of the present invention has the cutout portion in the portion at which the cleaning liquid supply flow channel is opened to the air, and accordingly can facilitate the cleaning liquid to flow through this cutout portion, and can pass the cleaning liquid in a direction of having the cutout portion.

In the nozzle face cleaning device according to other aspect of the present invention, it is preferable that the cleaning liquid supply flow channel and the cleaning liquid adding nozzle are connected to each other through a rubber seal member.

In the nozzle face cleaning device according to the other aspect of the present invention, the cleaning liquid supply flow channel and the cleaning liquid adding nozzle are connected to each other through the rubber seal member. Accordingly, a connected portion of the cleaning liquid supply flow channel with the cleaning liquid adding nozzle can be firmly sealed, and liquid leakage does not occur. Thereby, the nozzle face cleaning device can efficiently add the cleaning liquid to the wiping member.

In the nozzle face cleaning device according to other aspect of the present invention, it is preferable that a tip portion of the cleaning liquid adding nozzle has a bent shape.

The nozzle face cleaning device according to the other aspect of the present invention has the cleaning liquid adding nozzle of which the tip is the bent shape, thereby can drip the cleaning liquid from the tip having the bent shape, and accordingly can supply the cleaning liquid to a fixed position.

In the nozzle face cleaning device according to other aspect of the present invention, it is preferable that a shape of the tip portion of the cleaning liquid adding nozzle is an acute angle.

In the nozzle face cleaning device according to other aspect of the present invention, it is preferable that a shape of the tip portion of the cleaning liquid adding nozzle is a semicircular shape of which the curvature radius R is 1 cm or smaller.

The nozzle face cleaning device according to the other aspects of the present invention has the cleaning liquid adding nozzle of which the shape of the tip is the acute angle or the semicircular shape, and thereby can enhance dripping properties of the tip shape, and can supply a predetermined amount of the cleaning liquid.

In the nozzle face cleaning device according to other aspect of the present invention, it is preferable that a surface of the cleaning liquid adding nozzle is formed from a water-repellent material.

The nozzle face cleaning device according to the other aspect of the present invention has the cleaning liquid adding nozzle of which the surface is formed from the water-repellent material, and accordingly can enhance the dripping properties of the cleaning liquid; and accordingly can facilitate the wiping member to add a predetermined amount of the cleaning liquid.

In a method of forming the surface of the cleaning liquid adding nozzle into the water-repellent material, a material having water repellency and adequate dripping properties can be used for a material of the cleaning liquid adding nozzle. In addition, a surface of the cleaning liquid adding nozzle can be coated with a water-repellent material.

In the nozzle face cleaning device according to other aspect of the present invention, it is preferable that the nozzle face is arranged so as to be tilted against a horizontal plane, and the pressing means is arranged so as to be tilted so as to correspond to the nozzle face.

The nozzle face cleaning device according to the other aspect of the present invention has a tilted head of which the nozzle face is arranged so as to be tilted against the horizontal plane, but even so, can wipe the nozzle face by tilting the pressing means so as to correspond to the nozzle face.

In the nozzle face cleaning device according to other aspect of the present invention, it is preferable that a position at which the cleaning liquid is added to the wiping member from the cleaning liquid adding nozzle is provided in the upper side of tilt.

The nozzle face cleaning device according to the other aspect of the present invention adds the cleaning liquid in the upper side of the tilt, and thereby can spread the cleaning liquid on the wiping member by gravity. Accordingly, the nozzle face cleaning device can add the cleaning liquid in the width direction of the wiping member by providing a cleaning liquid nozzle in one portion in the width direction of the wiping member, and accordingly the device can be miniaturized.

It is preferable that the nozzle face cleaning device according to other aspect of the present invention supplies the cleaning liquid to the cleaning liquid adding nozzle by water head difference.

The nozzle face cleaning device according to the other aspect of the present invention supplies the cleaning liquid by the water head difference, and thereby can supply the cleaning liquid without using a pump, a nozzle, an ejection member (spray) or the like for supplying the cleaning liquid; and accordingly, can miniaturize the device, and can keep an inner part of the mechanism clean.

In order to achieve the above described objects, the present invention provides an image recording device which includes: conveyance means configured to convey a recording medium; a droplet ejection head configured to eject an ink droplet onto a recording medium which is conveyed by the conveyance means to form an image; and the nozzle face cleaning device that cleans the nozzle face of the droplet ejection head and is described above.

The image recording device according to the present invention includes the nozzle face cleaning device, and can enhance its ejection stability. In addition, the nozzle face cleaning device can be miniaturized, and accordingly the image recording device can enhance the selectivity of arrangement for each component of itself. In addition, the wiping member can reliably wipe the nozzle face in the state of having the cleaning liquid added thereon, and accordingly can prevent the nozzle face from being damaged.

The nozzle face cleaning device and the image recording device of the present invention have the cleaning liquid supply flow channel and the cleaning liquid adding nozzle divided at a place at which the cleaning liquid supply flow channel is opened to the air in the connected portion of the cleaning liquid supply flow channel with the cleaning liquid adding nozzle; also enable the cleaning liquid supply flow channel and the cleaning liquid adding nozzle to be attached to and detached from each other; and accordingly can prevent the air bubbles from entering into the cleaning liquid supply flow channel, when the cleaning liquid adding nozzle is replaced. In addition, the nozzle face cleaning device and the image recording device are structured so that the cleaning liquid adding nozzle is integrated with a case in which the pressing member, the wiping member and the like for wiping the nozzle face are integrated, accordingly the cleaning liquid can be set at a predetermined position, and the cleaning liquid adding nozzle does not need to be positioned. Accordingly, the nozzle face cleaning device and the image recording device can enhance the operability when the cleaning liquid adding nozzle, the wiping member and the like are replaced.

DETAILED DESCRIPTION OF EXEMPLARY EMBODIMENTS

Preferable embodiments of the nozzle face cleaning device and the image recording device according to the present invention are described below with reference to the attached drawings. An ink jet recording device is described as one example of the image recording device.

<<Structure of Image Recording Section of Ink Jet Recording Device>>

Figure 1:
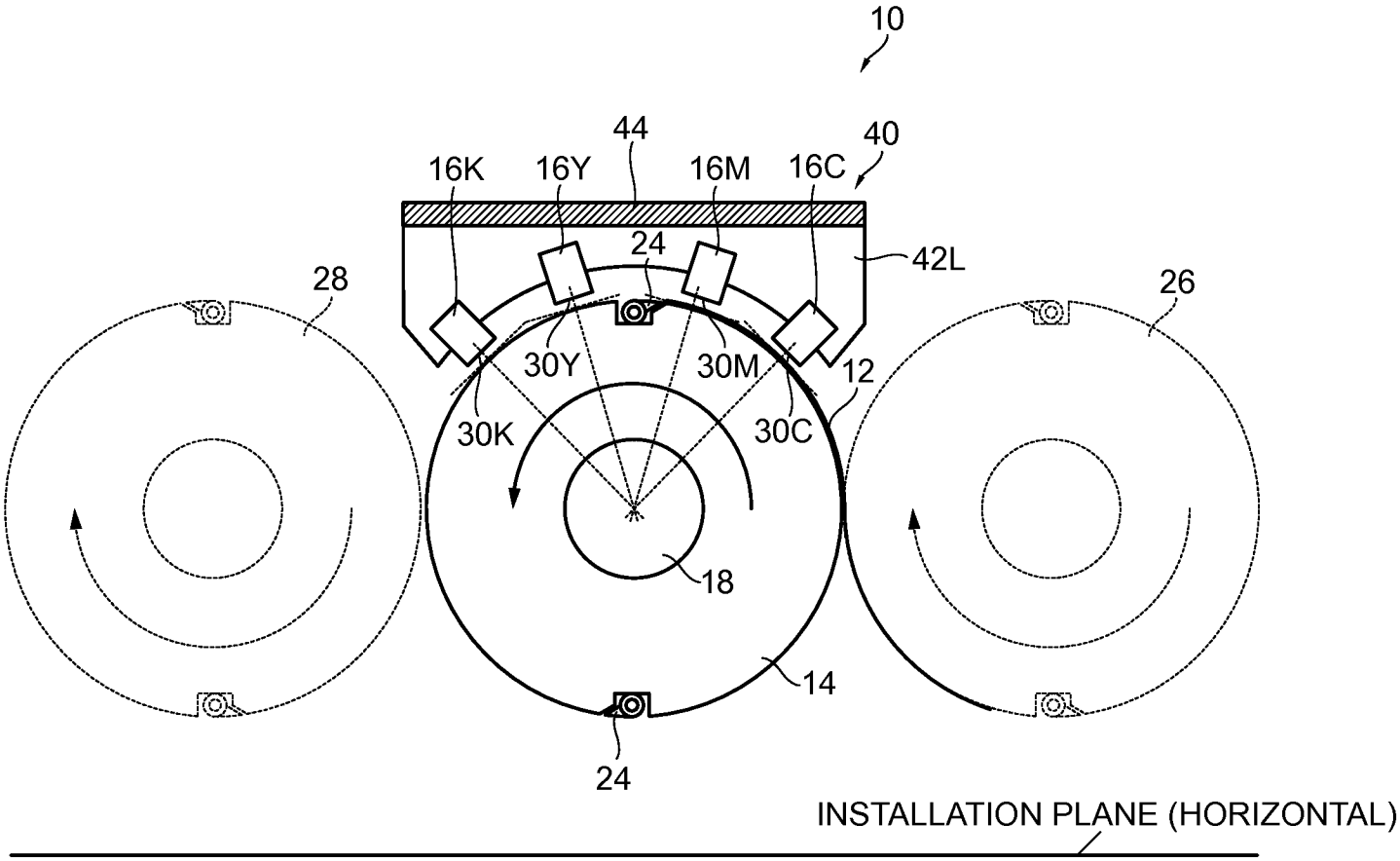
FIG. 1 is a sectional view illustrating a schematic structure of an image recording section of an ink jet recording device.

FIG. 1 is a side view illustrating a schematic structure of an image recording section of the ink jet recording device.

As is illustrated in FIG. 1, the image recording section 10 of the ink jet recording device of the present embodiment conveys a recording medium (sheet) 12 with a drum of an image recording drum 14 (conveyance means). Then, the image recording section 10 makes ink jet heads (droplet ejection head) 16C, 16M, 16Y and 16K which are arranged in the periphery of the image recording drum 14 eject ink droplets (ink droplet) of each color of C (cyan), M (magenta), Y (yellow) and K (black), in the conveyance step due to the image recording drum 14, and records an image of a color image on the surface of the recording medium 12.

Figure 2:
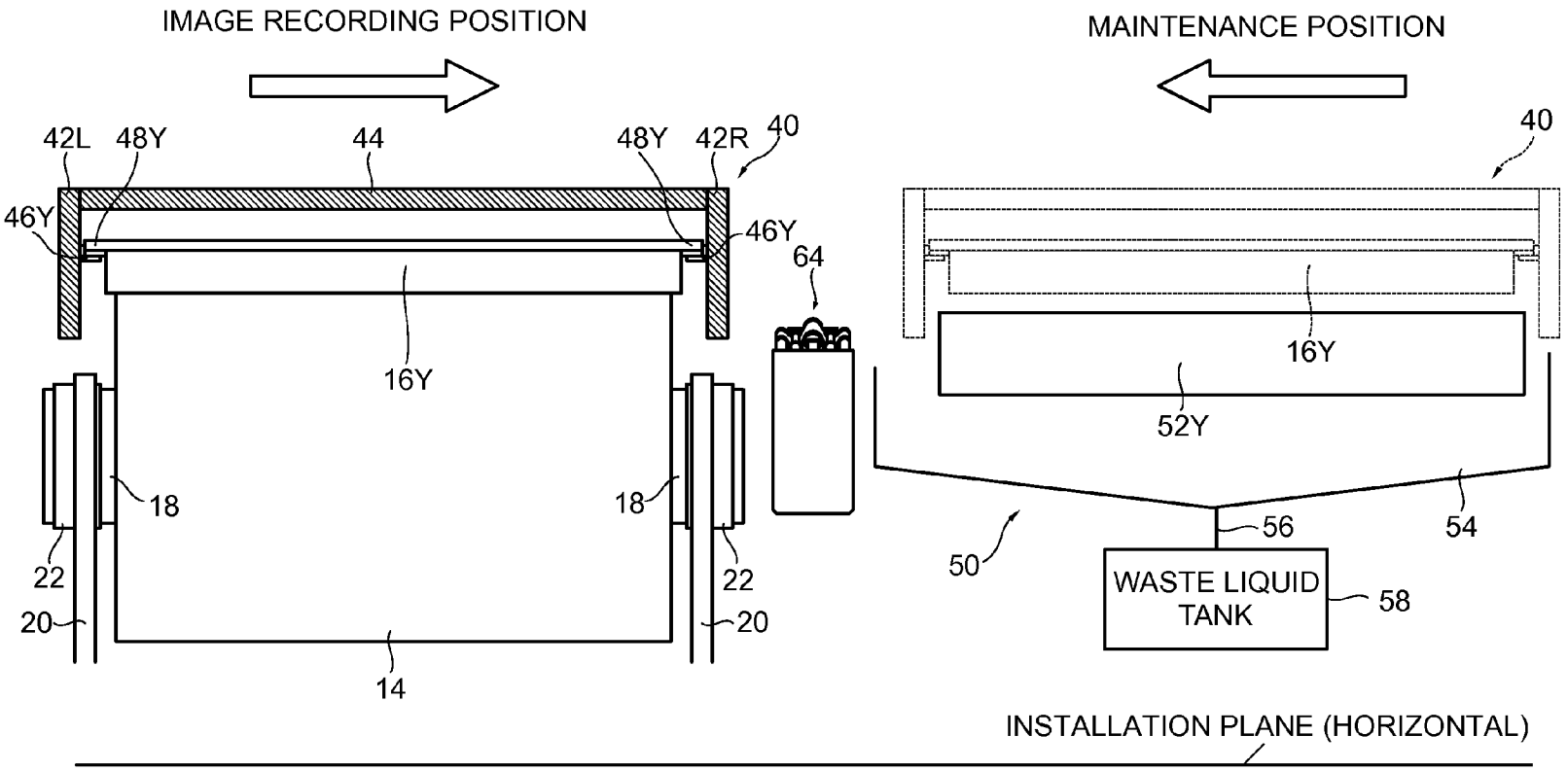
FIG. 2 is a front view of the image recording section of the ink jet recording device.

The image recording drum 14 is rotatably provided while both ends of the rotary shaft 18 thereof are supported by a pair of bearings 22 (see FIG. 2). The pair of bearings 22 are provided on a body frame 20 of the ink jet recording device, both of the ends of the rotary shaft 18 are supported by the pair of bearings 22, and thereby the image recording drum 14 is horizontally attached (The rotary shaft 18 is attached in parallel to a horizontal installation plane).

A motor is connected to the rotary shaft 18 of the image recording drum 14 through an unillustrated rotation transmission mechanism. The image recording drum 14 is driven by this motor, and is rotated.

In addition, a gripper 24 which grips the tip part of the recording medium 12 is provided on the peripheral surface of the image recording drum 14 (In the present example, the grippers are installed in two places on the outer peripheral surface). The recording medium 12 is held on the outer peripheral surface of the image recording drum 14 while the tip part is gripped by this gripper 24.

In addition, this image recording drum 14 is provided with an unillustrated absorption holding mechanism (for instance, electrostatic absorption and vacuum absorption). The recording medium 12 which is wound on an outer peripheral surface of the image recording drum 14 while a tip part is gripped by the gripper 24 is held on the outer peripheral surface of the image recording drum 14 while a rear face part thereof is absorbed by the absorption holding mechanism.

Incidentally, in the ink jet recording device of the present embodiment, the recording medium 12 is delivered to the image recording drum 14 through a conveyance drum 26 from the step in the preceding stage. The conveyance drum 26 is arranged in parallel to the image recording drum 14, and delivers the recording medium 12 to the image recording drum 14 at synchronized timing.

In addition, the recording medium 12 on which the image has been recorded is delivered to the step in the latter stage through a conveyance drum 28. The conveyance drum 28 is arranged in parallel to the image recording drum 14, and receives the recording medium 12 from the image recording drum 14 at synchronized timing.

Four ink jet heads 16C, 16M, 16Y and 16K are structured by line heads corresponding to the width of the recording medium, and are radially arranged so as to have a fixed interval on a concentric circle which regards the rotary shaft 18 of the image recording drum 14 as a center.

Incidentally, in the present example, the four ink jet heads 16C, 16M, 16Y and 16K are arranged so as to become symmetric while sandwiching the image recording drum 14. Specifically, the ink jet head 16C of the cyan and the ink jet head 16K of the black are symmetrically arranged with respect to a vertical line passing through the center of the image recording drum 14, and the ink jet head 16M of the magenta and the ink jet head 16Y of the yellow are also symmetrically arranged.

As for each of thus arranged ink jet heads 16C, 16M, 16Y and 16K, the nozzle faces 30C, 30M, 30Y and 30K which are formed on the respective lower ends of the heads are arranged so as to face the outer peripheral surface of the image recording drum 14, and the nozzle faces 30C, 30M, 30Y and 30K thereof are also positioned each at a position having a predetermined height from the outer peripheral surface of the image recording drum 14 (Gaps having the same distance are formed between an outer peripheral surface of image recording drum 14 and nozzle faces 30C, 30M, 30Y and 30K, respectively.). In addition, the columns of the nozzles which are formed on the respective nozzle faces 30C, 30M, 30Y and 30K are arranged so as to be perpendicular to the conveyance direction of the recording medium 12.

The droplets of the inks are ejected perpendicularly toward the outer peripheral surface of the image recording drum 14 from thus arranged ink jet heads 16C, 16M, 16Y and 16K, through the respective nozzles which are formed in the nozzle faces 30C, 30M, 30Y and 30K.

Figure 3:
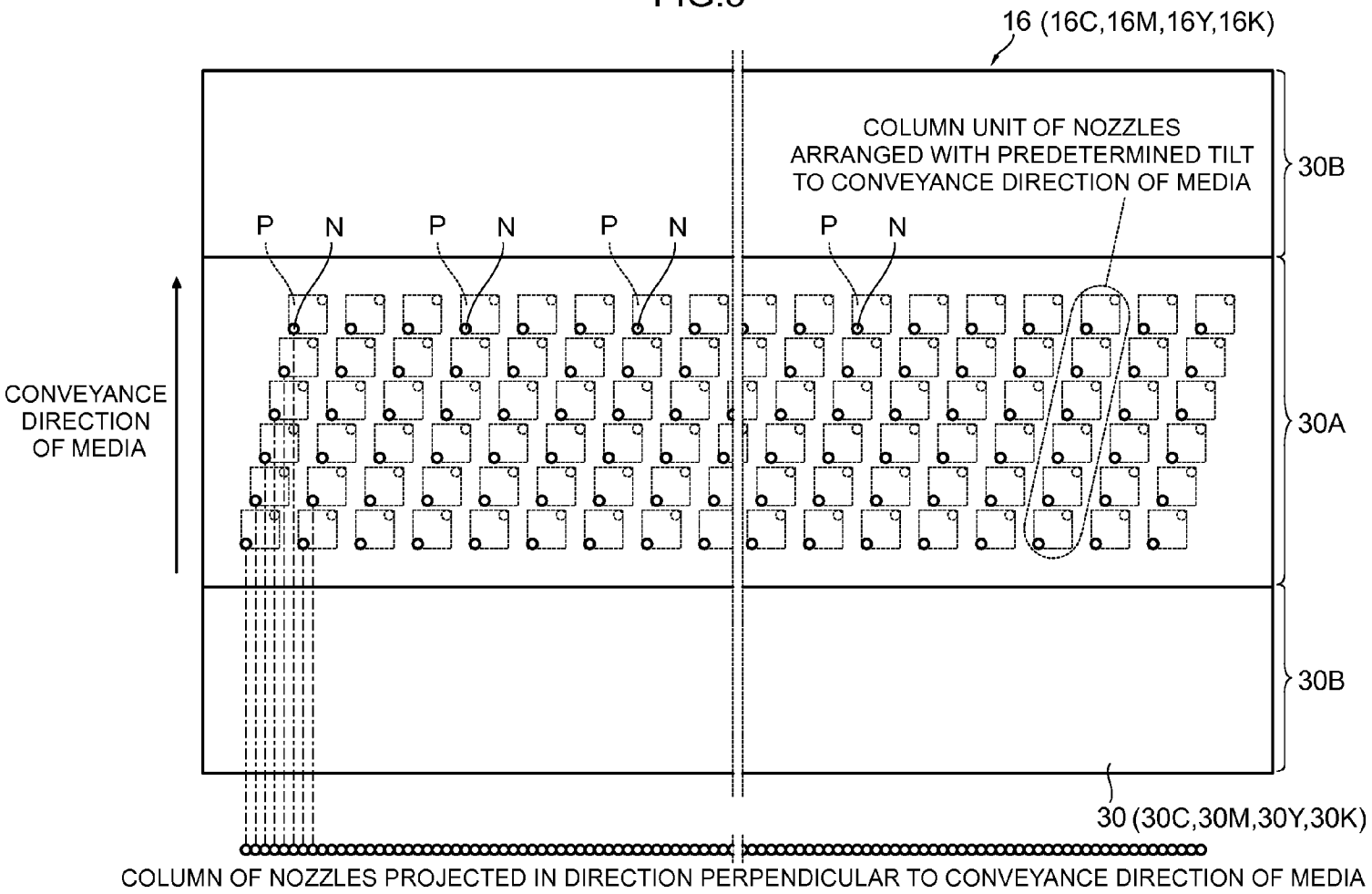
FIG. 3 is a perspective plan view of a nozzle face of an ink jet head.

FIG. 3 is a perspective plan view of the nozzle face of the ink jet head.

Incidentally, the structures of each of the ink jet heads 16C, 16M, 16Y and 16K are common, and accordingly, here, the structure of the nozzle face 30 (30C, 30M, 30Y and 30K) is described below as the ink jet head 16.

As is illustrated in FIG. 3, the nozzle face 30 is formed to have a rectangular shape, a nozzle-formed region 30A having a fixed width is formed in the middle part in the width direction (conveyance direction of recording medium), and nozzle protection regions 30B are formed symmetrically so as to sandwich the nozzle-formed region 30A.

The nozzle-formed region 30A is a region in which the nozzles are formed, and predetermined liquid-repellent treatment is applied to the surface thereof (in other words, the surface is coated with liquid-repellent film).

Here, as is illustrated in FIG. 3, the ink jet head 16 of the present embodiment is structured by a so-called matrix head, and nozzles N are arranged in a two-dimensional matrix form in the nozzle-formed region 30A. More specifically, the columns of the nozzles are formed, in which a plurality of nozzles N are arranged in a direction of being tilted against the conveyance direction of the recording medium 12 by a predetermined angle, at a fixed pitch, and a large number of the columns of the nozzles are arrayed in a direction (longitudinal direction of head) perpendicular to the conveyance direction of the recording medium 12, at a fixed pitch. By having such an arrangement structure of the nozzles, a substantial gap among the nozzles N which are projected to a longitudinal direction (a direction perpendicular to the conveyance direction of the recording medium 12) of the head can be narrowed, and the density of the nozzles N can be increased.

Incidentally, in the matrix head, the column of the nozzles which are projected to the longitudinal direction of the head is regarded as a substantial column of nozzles.

The nozzle protection regions 30B arranged in both sides of the nozzle-formed region 30A are regions for protecting the nozzle-formed region 30A. The nozzle-formed region 30A is retracted from this nozzle protection region 30B by a predetermined amount, and is formed into a recessed shape (approximately by 0.2 mm).

Incidentally, in the ink jet head 16 of the present embodiment, only the nozzle-formed region 30A is subjected to the liquid-repellent treatment (while nozzle protection region 30B is not subjected to liquid-repellent treatment). In this case, when a liquid has been deposited onto the nozzle protection region 30B, the liquid gets wet and spreads on the nozzle protection region 30B.

In addition, the ink jet head 16 of the present embodiment ejects the droplet of the ink from the nozzle N by a so-called piezo method. Specifically, the nozzles N which are formed in the nozzle face 30 each communicate with respective pressure chambers P; and the pressure chamber P vibrates the wall face of itself by a piezo element, thereby expands and shrinks the volume of the pressure chamber P, and ejects the droplet of the ink from the nozzle N.

Incidentally, the ejection method of the ink is not limited to this method, and can include also methods of ejecting the ink by a thermal method and an electrostatic actuator.

The image recording section 10 is structured as in the above description. In this image recording section 10, the recording medium 12 is delivered from the step in the preceding stage to the image recording drum 14 through the conveyance drum 26, is absorbed and held on the peripheral surface of the image recording drum 14, and is rotated and conveyed to the conveyance drum 26. Then, the recording medium passes under each of the ink jet heads 16C, 16M, 16Y and 16K in the conveyance step, when the recording medium passes under the heads, the droplet of the ink, which has been ejected from each of the ink jet heads 16C, 16M, 16Y and 16K, is struck onto a recording face, and a color image is formed on the recording face. The recording medium 12 on which the image has been recorded is delivered to the conveyance drum 28 from the image recording drum 14, and is conveyed to the step in the latter stage.

Now, in the image recording section 10 structured as has been described above, each of the ink jet heads 16C, 16M, 16Y and 16K is attached to a head supporting frame 40, and is arranged in the periphery of the image recording drum 14, as is illustrated in FIG. 2.

The head supporting frame 40 is structured by a pair of side plates 42L and 42R which are provided so as to be perpendicular to the rotary shaft 18 of the image recording drum 14, and by a connection frame 44 which connects the pair of side plates 42L and 42R on the upper end.

The pair of side plates 42L and 42R is formed into a plate shape, and are arranged so as to face each other while sandwiching the image recording drum 14. In the inside of the pair of side plates 42L and 42R, attaching portions 46C, 46M, 46Y and 46K for attaching the respective ink jet heads 16C, 16M, 16Y and 16K thereto are provided (though only attaching portion 46Y is illustrated, for convenience, in FIG. 2).

The attaching portions 46C, 46M, 46Y and 46K are radially arranged so as to have a fixed interval on the concentric circle which regards the rotary shaft 18 of the image recording drum 14 as the center. Portions to be attached 48C, 48M, 48Y and 48K (though only portion to be attached 48Y is illustrated, for convenience, in FIG. 2) which are formed on both ends of the respective ink jet heads 16C, 16M, 16Y and 16K are fixed to the respective attaching portions 46C, 46M, 46Y and 46K, and thereby the ink jet heads are attached to the head supporting frame 40. The respective ink jet heads 16C, 16M, 16Y and 16K are thus attached to the head supporting frame 40, and thereby are radially arranged so as to have a fixed interval on the concentric circle which regards the rotary shaft 18 of the image recording drum 14 as the center.

The head supporting frame 40 is provided so as to slidably move in parallel to the rotary shaft 18 of the image recording drum 14 while being guided by an unillustrated guide rail. The head supporting frame 40 is driven by an unillustrated linear driving mechanism (for instance, feeding screw mechanism or the like), and moves between "image recording position" illustrated by a solid line in FIG. 2 and "maintenance position" illustrated by a dashed line in FIG. 2.

When the head supporting frame 40 is positioned on the image recording position, the respective ink jet heads 16C, 16M, 16Y and 16K are arranged in the periphery of the image recording drum 14, and become a state of being capable of recording an image.

The maintenance position is set at a position into which the respective ink jet heads 16C, 16M, 16Y and 16K are retracted from the image recording medium 14. In this maintenance position, a moisture-retaining unit 50 is provided for retaining the moisture of the respective ink jet heads 16C, 16M, 16Y and 16K.

The moisture-retaining unit 50 is provided with caps 52C, 52M, 52Y and 52K (though only cap 52Y is illustrated, for convenience, in FIG. 2) which cover the nozzle faces of the respective ink jet heads 16C, 16M, 16Y and 16K. When the device is halted for a long period of time, the nozzle faces are covered with these caps 52C, 52M, 52Y and 52K. Thereby, the non-ejection due to dryness is prevented.

Incidentally, these caps 52C, 52M, 52Y and 52K are provided with an unillustrated pressurization and suction mechanism, which is structured so as to be capable of pressurizing and sucking the inner part of the nozzle.

In addition, these caps 52C, 52M, 52Y and 52K are provided with an unillustrated cleaning liquid supply mechanism, which is structured so as to be capable of supplying the cleaning liquid to the inner part of the nozzle.

A waste liquid tray 54 is arranged in the lower position of the caps 52C, 52M, 52Y and 52K. The cleaning liquid which has been supplied to the caps 52C, 52M, 52Y and 52K is disposed into this waste liquid tray 54, and is collected into a waste liquid tank 58 through a waste liquid collection pipe 56.

A nozzle face cleaning device 64 for cleaning the nozzle faces 30C, 30M, 30Y and 30K of the respective ink jet heads 16C, 16M, 16Y and 16K is provided between the image recording position and the maintenance position. The nozzle faces 30C, 30M, 30Y and 30K of the respective ink jet heads 16C, 16M, 16Y and 16K are cleaned by this nozzle face cleaning device 64, in a process in which the respective ink jet heads move from the maintenance position to the image recording position or in a process in which the respective ink jet heads move from the image recording position to the maintenance position.

The structure of this nozzle face cleaning device 64 is described below.

<<Structure of Nozzle Face Cleaning Device>>

The nozzle face cleaning device 64 brings a wiping web into pressure-contact with the nozzle faces 30C, 30M, 30Y and 30K of the respective ink jet heads 16C, 16M, 16Y and 16K, and makes the wiping web wipe the nozzle faces 30C, 30M, 30Y and 30K. The nozzle face cleaning device 64 is arranged in the moving path of the head supporting frame 40. When the ink jet heads 16C, 16M, 16Y and 16K are moved from the maintenance position to the image recording position, the respective nozzle faces 30C, 30M, 30Y and 30K can be wiped by the wiping web.

Figure 4:
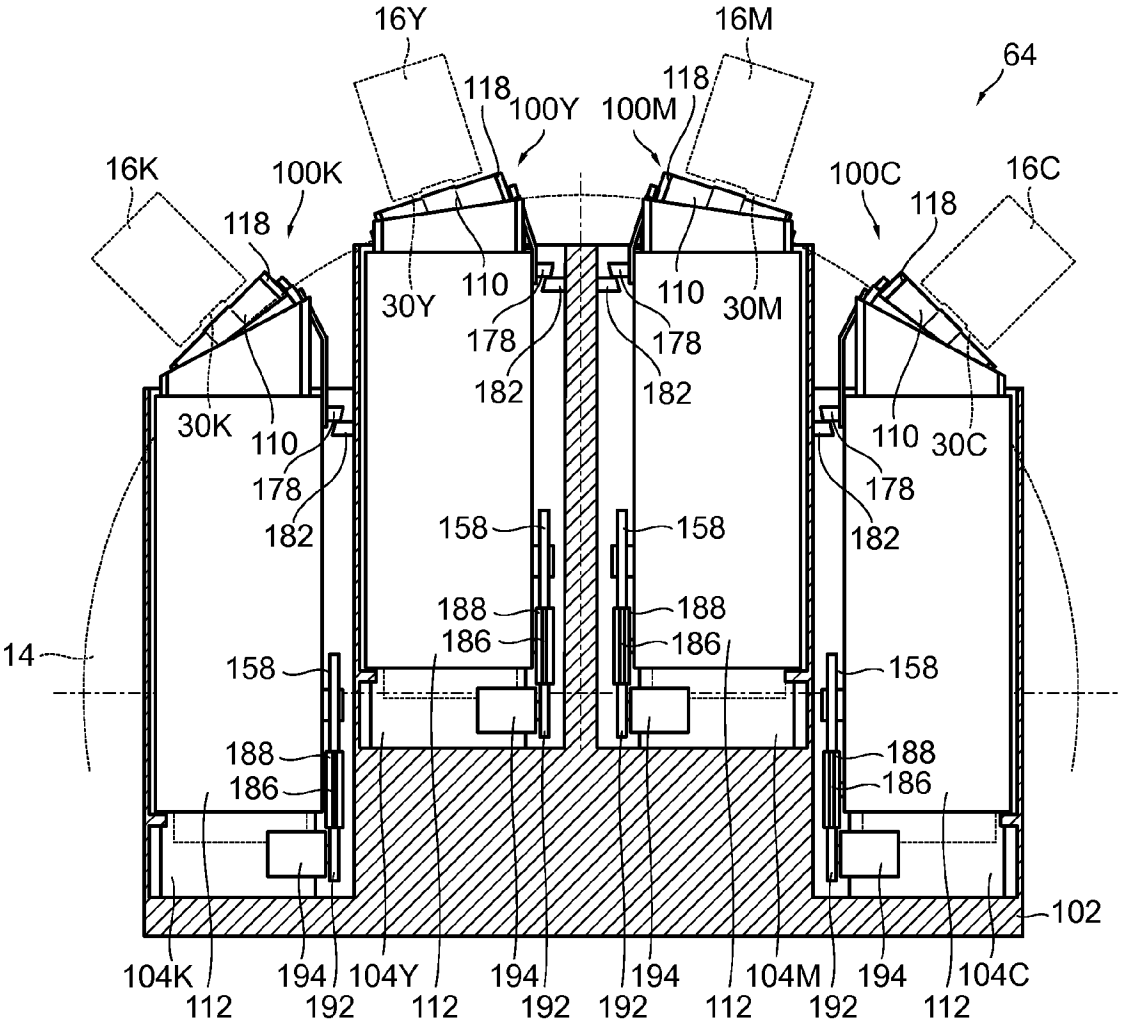
FIG. 4 is a side view of a cleaning device which is viewed from a side of a maintenance position.

FIG. 4 is a side view of the nozzle face cleaning device which is viewed from the side of the maintenance position.

As is illustrated in FIG. 4, the nozzle face cleaning device 64 is provided with wiping units 100C, 100M, 100Y and 100K which are provided so as to correspond to the respective ink jet heads 16C, 16M, 16Y and 16K, and with a body frame 102 of the cleaning device, on which the wiping units 100C, 100M, 100Y and 100K are set.

(Structure of Body Frame of Cleaning Device)

The body frame 102 of the cleaning device is horizontally installed, and is provided so as to be capable of moving up and down by an unillustrated elevating device. This body frame 102 of the cleaning device is formed into such a box shape that the upper end is opened, and has wiping unit mounting portions 104C, 104M, 104Y and 104K formed therein for mounting the respective wiping units 100C, 100M, 100Y and 100K.

The wiping unit mounting portions 104C, 104M, 104Y and 104K are formed as spaces in which the wiping units 100C, 100M, 100Y and 100K can be accommodated, respectively, and each upper part is formed so as to be opened. The wiping units 100C, 100M, 100Y and 100K are set in the respective wiping unit mounting portions 104C, 104M, 104Y and 104K by being inserted vertically downward from the respective openings in the upper parts of the respective wiping unit mounting portions 104C, 104M, 104Y and 104K.

Incidentally, the respective wiping unit mounting portions 104C, 104M, 104Y and 104K are provided with unillustrated locking mechanisms, which are structured so as to be capable of locking the respective mounted wiping units 100C, 100M, 100Y and 100K. The locking mechanisms are structured so as to automatically work, for instance, when wiping units 100C, 100M, 100Y and 100K are inserted into the respective wiping unit mounting portions 104C, 104M, 104Y and 104K.

<Structure of Wiping Unit>

Next, the structure of the wiping units 100C, 100M, 100Y and 100K is described below.

Incidentally, the basic structures of the respective wiping units 100C, 100M, 100Y and 100K are common, and accordingly, here, the structure of the wiping unit is described below as the wiping unit 100. The wiping unit mounting portions 104C, 104M, 104Y and 104K are also similar to the above case of the wiping units, and the structure is described as the wiping unit mounting portion 104.

Figure 5:
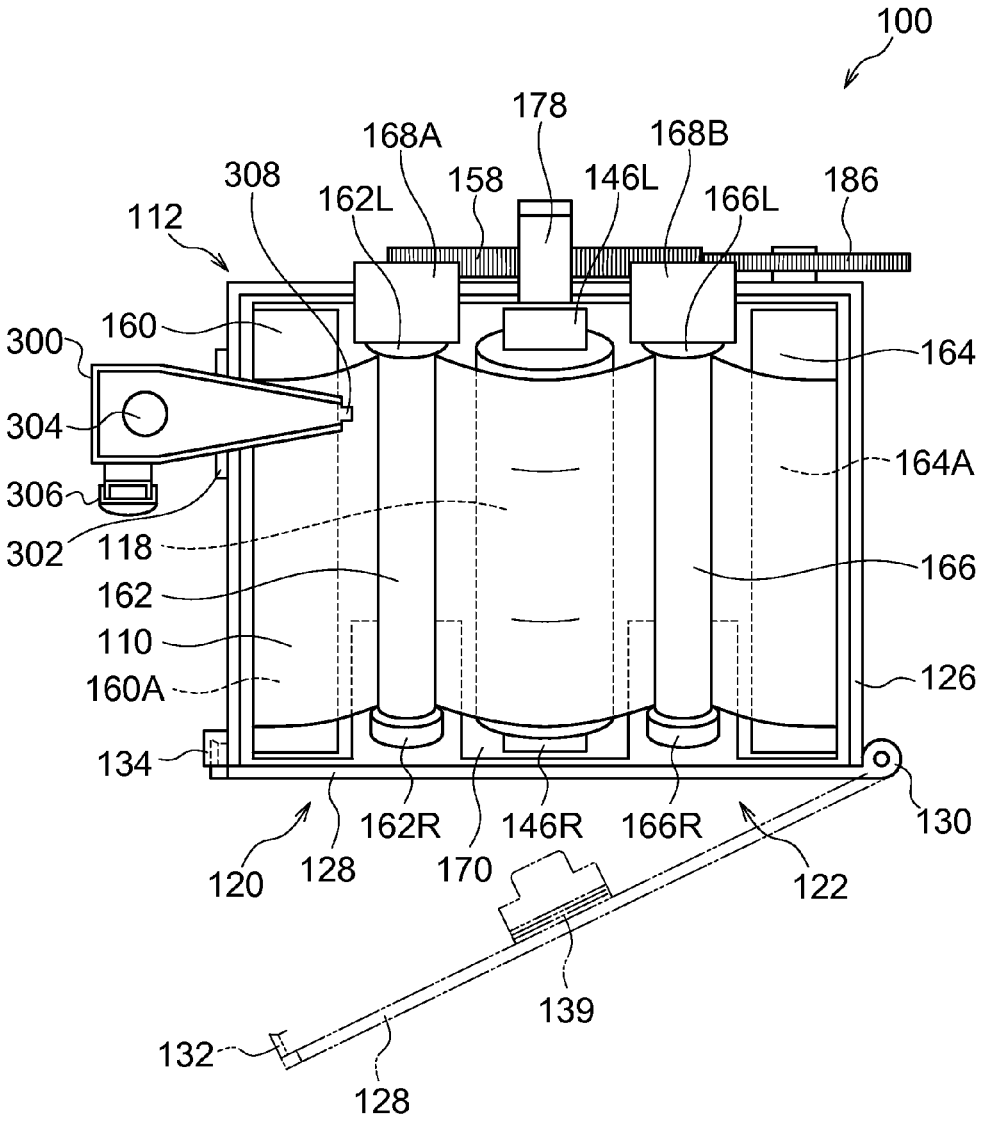
FIG. 5 is a plan view of a wiping unit.
Figure 6:
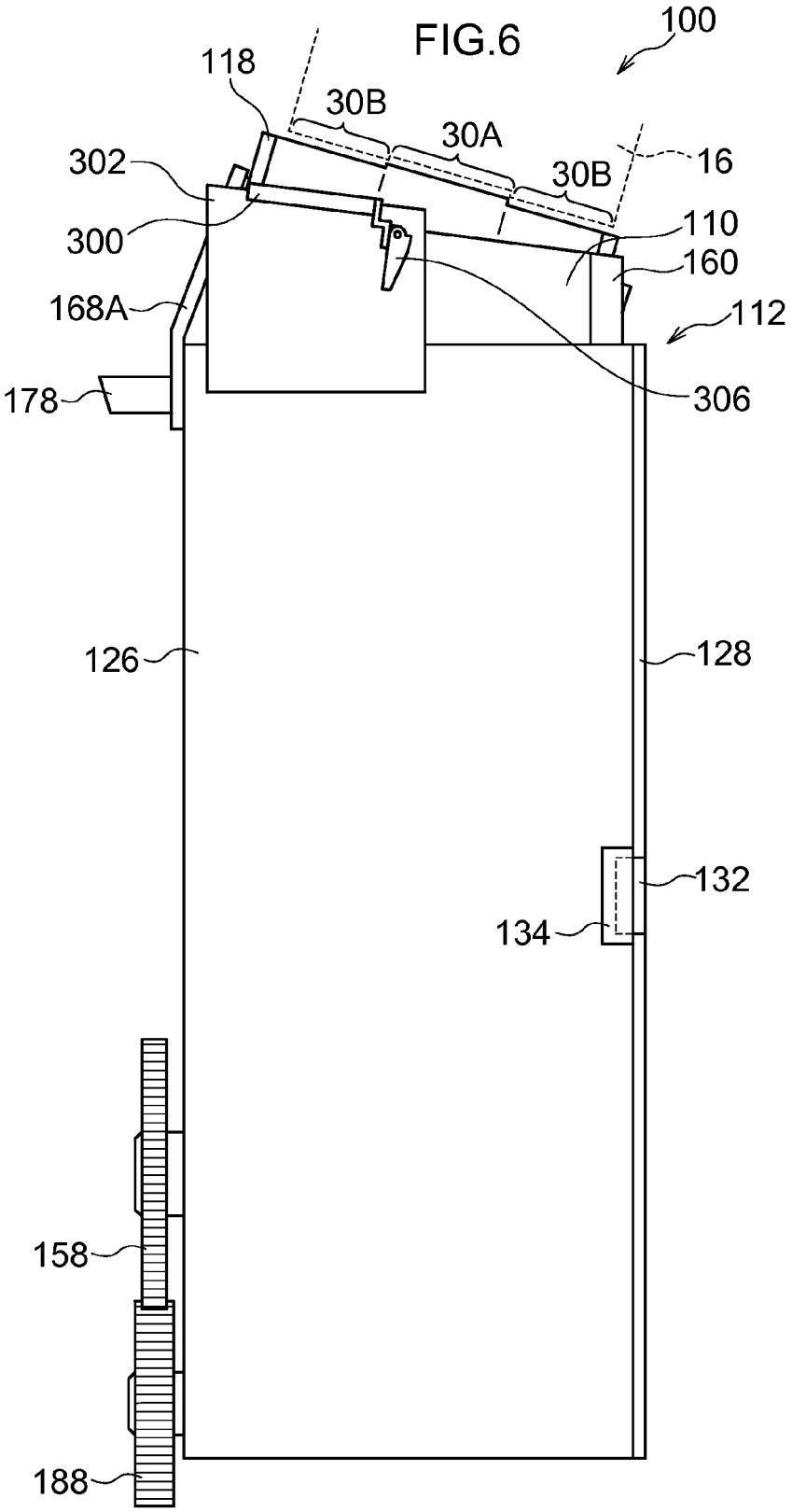
FIG. 6 is a side view of the wiping unit which is viewed from a side of an image recording position.
Figure 7:
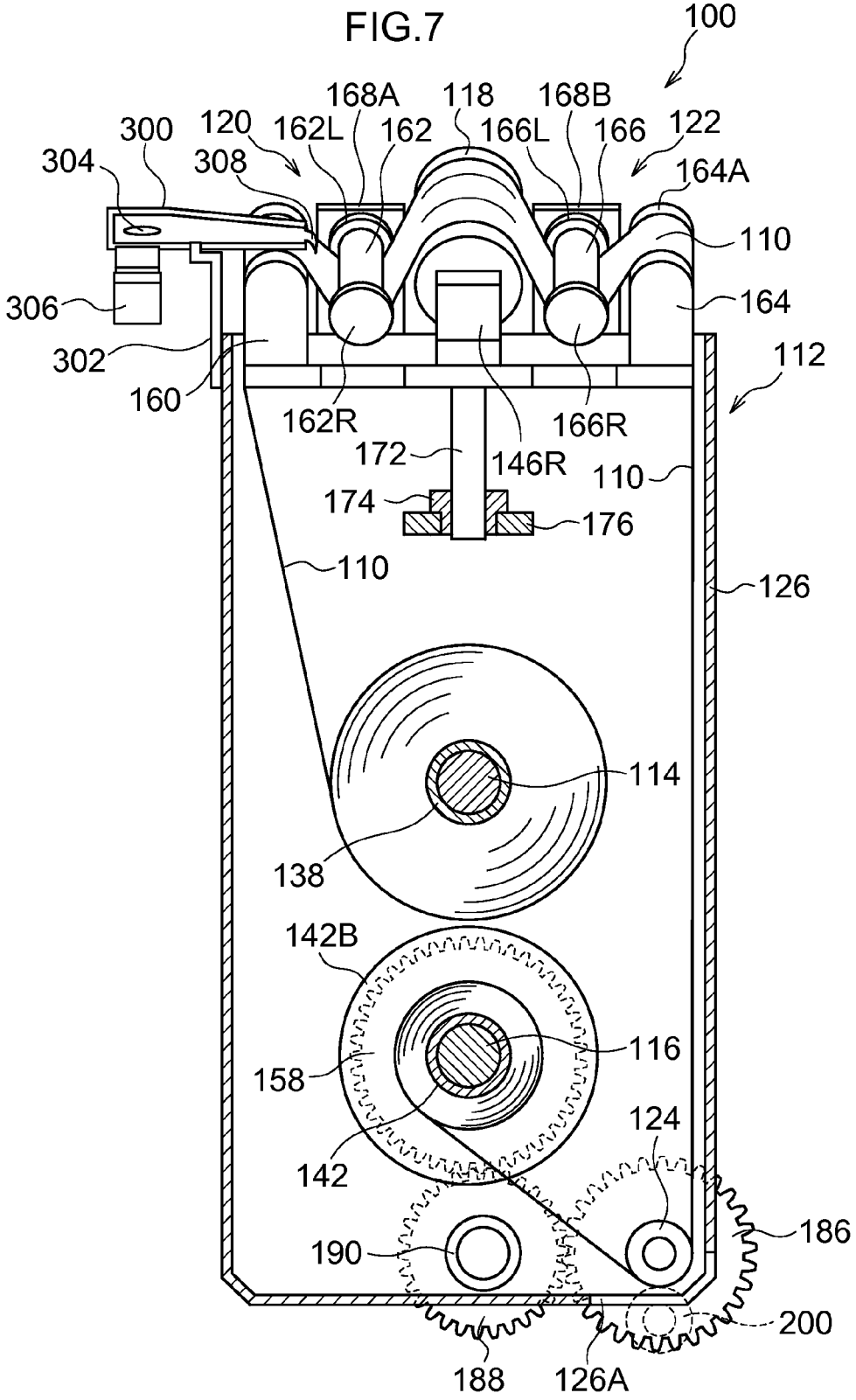
FIG. 7 is a sectional view of a front face portion of the wiping unit.

FIG. 5 is a plan view of the wiping unit, FIG. 6 is a side view of the wiping unit which is viewed from the side of the image recording position, and FIG. 7 is a sectional view of a front portion of the wiping unit.

As is illustrated in FIG. 5 to FIG. 7, in the wiping unit 100, a wiping web (wiping member) 110 which is formed into a strip shape is wound around a pressing roller 118 (pressing means) that has been provided so as to be tilted. The wiping unit 100 brings the wiping web 110 which is wound around this pressing roller 118, into pressure-contact with the nozzle face of the ink jet head. The wiping unit 100 moves the ink jet head 16 from the maintenance position illustrated in FIG. 2 to the image recording position, makes the wiping web 110 travel along the conveyance path, while bringing the wiping web 110 into pressure-contact with the nozzle face, and thereby makes the wiping web 110 wipe and clean the nozzle face 30 of the ink jet head 16.

This wiping unit 100 includes: a case 112; the pressing roller 118; an unwinding shaft 114 for unwinding the wiping web 110 which is formed into the strip shape; a winding shaft 116 for winding the wiping web 110; a pre-stage guide 120 for guiding the wiping web 110 so that the wiping web 110 which has been unwound from the unwinding shaft 114 is wound around the pressing roller 118; a post-stage guide 122 for guiding the wiping web 110 so that the wiping web 110 which has been wound around the pressing roller 118 is wound around the winding shaft 116; and a grid roller (driving roller) 124 for conveying the wiping web 110. In the present embodiment, "wiping means" is wiping member travel driving means which is formed of ink jet head moving means, the unwinding shaft 114, the winding shaft 116, and the grid roller 124.

A material to be used for the wiping web 110 includes, for instance, a knit or woven sheet using ultrafine fibers of PET (polyethylene terephthalate), PE (polyethylene), NY (nylon (registered trademark), polyamide-based synthetic fiber), acrylic and the like. The wiping web 110 is formed into the strip shape having a width (width equal to or larger than width of nozzle face) corresponding to the width of the nozzle face in a head to be wiped.

The pressing roller 118 is arranged above the unwinding shaft 114 (In present example, the pressing roller 118, the unwinding shaft 114 and the winding shaft 116 are arranged on the same straight line.), and is arranged so as to be tilted against the horizontal plane by a predetermined angle. Specifically, this pressing roller 118 is a unit for bringing the wiping web 110 into pressure-contact with the nozzle face 30 of the ink jet head 16, and accordingly is arranged so as to be tilted so as to match the tilt of the nozzle face 30 of the ink jet head 16 to be wiped (being arranged so as to be parallel to nozzle face).

The pre-stage guide 120 includes a first pre-stage guide 160 and a second pre-stage guide 162. The pre-stage guide 120 guides the wiping web 110 which has been unwound from the unwinding shaft 114 so that the wiping web 110 is wound around the pressing roller 118 that is installed so as to be tilted.

On the other hand, the post-stage guide 122 includes a first post-stage guide 164 and a second post-stage guide 166. The post-stage guide 122 guides the wiping web 110 which has been wound around the pressing roller 118 that is installed so as to be tilted so that the wiping web 110 is wound around the winding shaft 116 which is horizontally installed.

These pre-stage guide 120 and post-stage guide 122 are symmetrically arranged so as to sandwich the pressing roller 118. Specifically, the first pre-stage guide 160 and the first post-stage guide 164 are symmetrically arranged so as to sandwich the pressing roller 118, and the second pre-stage guide 162 and the second post-stage guide 166 are also symmetrically arranged so as to sandwich the pressing roller 118.

The first pre-stage guide 160 is formed into a plate shape having a predetermined width, and is vertically installed so as to stand on an elevating stage 170. In this first pre-stage guide 160, an upper rim part 160A is formed as a winding section for the wiping web 110, and the surface is formed into an arc shape. In addition, this upper rim part 160A is formed so as to be tilted against the horizontal plane by a predetermined angle. Thereby, the traveling direction of the wiping web 110 is changed.

The first post-stage guide 164 has the same structure as that of the first pre-stage guide 160. Specifically, the first post-stage guide 164 is formed into a plate shape having a predetermined width, and is vertically installed so as to stand on the elevating stage 170. In addition, an upper rim part 164A thereof is formed as a winding section for the wiping web 110, the surface is formed into an arc shape, and is formed so as to be tilted against the horizontal plane by a predetermined angle.

These first pre-stage guide 160 and first post-stage guide 164 are symmetrically arranged so as to sandwich the pressing roller 118. The wiping web 110 which has been unwound from the unwinding shaft 114 is wound around the first pre-stage guide 160, and thereby the direction thereof is converted to a direction approximately perpendicular to the pressing roller 118 from a direction perpendicular to the unwinding shaft 114. In addition, the wiping web 110 which has been wound around the second post-stage guide 166 that is described later is wound around the first post-stage guide 164, and thereby the direction thereof is converted to a direction perpendicular to the winding shaft 116.

The second pre-stage guide 162 is structured as a guide roller which has flanges 162L and 162R on both ends thereof. This second pre-stage guide 162 is arranged between the first pre-stage guide 160 and the pressing roller 118, and guides the wiping web 110 which has been wound around the first pre-stage guide 160 so that the wiping web 110 is wound around the pressing roller 118. Specifically, the second pre-stage guide 162 finely adjusts the traveling direction of the wiping web 110 so that the wiping web 110 of which the direction has been converted to a direction approximately perpendicular to the pressing roller 118 by the first pre-stage guide 160 travels in a direction perpendicular to the pressing roller 118. In addition, the flanges 162L and 162R on both ends prevent the wiping web 110 from obliquely traveling.

This second pre-stage guide 162 is provided so as to be tilted by a predetermined angle while one end of the second pre-stage guide 162 is cantilevered and supported by a bracket 168A. The bracket 168A is formed into a shape of the plate of which the tip is bent, and of which the base end is fixed to the upper end of the rear face of the case body 126, as is illustrated in FIG. 6. The bracket 168A is provided so as to project vertically toward the upper part from the upper end of the case body 126. The second pre-stage guide 162 is cantilevered and supported by the bent portion of the tip of this bracket 168A, and is rotatably supported by the bent portion.

The second post-stage guide 166 has the same structure as that of the second pre-stage guide 162. Specifically, the second post-stage guide 166 is structured as a guide roller which has flanges 166L and 166R on both ends thereof, and is provided so as to be tilted by a predetermined angle while one end thereof is cantilevered and supported by a bracket 168B. The bracket 168B is formed into a shape of the plate of which the tip is bent, and of which the base end is fixed to the upper end of the rear face of the case body 126. The second post-stage guide 166 is cantilevered and supported by the bent portion of the tip of this bracket 168B, and is rotatably supported by the bent portion.

This second post-stage guide 166 is arranged between the pressing roller 118 and the first post-stage guide 164, and guides the wiping web 110 which has been wound around the pressing roller 118 so that the wiping web 110 is wound around the first post-stage guide 164.

These second pre-stage guide 162 and second post-stage guide 166 are symmetrically arranged so as to sandwich the pressing roller 118. The wiping web 110 of which the direction has been converted to a direction approximately perpendicular to the pressing roller 118 by the first pre-stage guide 160 is wound around the second pre-stage guide 162, and thereby the traveling direction of the wiping web 110 is finely adjusted so that the wiping web 110 travels in a direction perpendicular to the pressing roller 118. In addition, the traveling direction of the wiping web 110 which has been wound around the pressing roller 118 is finely adjusted by the second post-stage guide 166 so that the wiping web 110 is wound around the first post-stage guide 164. Then, the wiping web 110 is wound around the first post-stage guide 164, and thereby the direction of the wiping web 110 is converted to a direction perpendicular to the winding shaft 116.

Thus, the pre-stage guide 120 and the post-stage guide 122 switch the traveling direction of the wiping web 110 step by step, and thereby guide the wiping web 110 so that the wiping web 110 is naturally wound around the pressing roller 118.

The grid roller 124 is installed in parallel to the winding shaft 116 (which is parallel to horizontal plane), and the rotary shaft thereof is rotatably supported by a bearing which is provided on the case body 126. As for the rotary shaft, the base end is provided so as to project to the outside of the case body 126, and a grid roller gear 186 is fixed on the projecting base end. This grid roller gear 186 is rotationally driven, and thereby the grid roller 124 is rotated.

Here, a driving mechanism of the wiping unit 100 which includes this grid roller 124 is described.

In the wiping unit 100 of the present embodiment, the winding shaft 116 is rotationally driven, the grid roller 124 is also rotationally driven, and thereby the wiping web 110 travels toward the winding shaft 116 from the unwinding shaft 114.

As in the above description, a winding shaft gear 158 is attached to the winding shaft 116. On the other hand, the grid roller gear 186 is attached to the grid roller 124. These winding shaft gear 158 and grid roller gear 186 are engaged with a rotation transmission gear 188, as is illustrated in FIG. 7.

The rotation transmission gear 188 has the rotary shaft horizontally provided which is rotatably supported by a bearing 190 that is provided on the case body 126. When this rotation transmission gear 188 is rotated, the winding shaft gear 158 and the grid roller gear 186 thereby rotate in the same direction. These winding shaft gear 158 and grid roller gear 186 rotate, and thereby the winding shaft 116 and the grid roller 124 rotate.

When the wiping unit 100 is mounted on the wiping unit mounting portion 104 of the cleaning device body frame 102, the rotation transmission gear 188 for rotating the winding shaft gear 158 and the grid roller gear 186 is engaged with a driving gear 192 which is provided in the wiping unit mounting portion 104 (see FIG. 4).

The driving gear 192 is attached to the output shaft of the motor 194, and is arranged at a position at which the rotation transmission gear 188 is engaged with the driving gear 192, when the wiping unit 100 is mounted on the wiping unit mounting portion 104.

A motor 194 is formed, for instance, of a pulse motor, and is attached to the bottom part of the wiping unit mounting portion 104. The drive of this motor 194 is controlled by an unillustrated control device.

The driving mechanism of the wiping unit 100 is structured as described above.

As in the above description, when the wiping unit 100 is mounted on the wiping unit mounting portion 104 of the body frame 102 of the cleaning device, the rotation transmission gear 188 which is provided on the case 112 of the wiping unit 100 is engaged with the driving gear 192 that is provided on the wiping unit mounting portion 104. When the motor 194 is driven in this state, the driving gear 192 rotates which is attached to the output shaft of the motor 194, the rotation is transmitted to the rotation transmission gear 188, and the rotation transmission gear 188 rotates.

When the rotation transmission gear 188 rotates, the rotation of the rotation transmission gear 188 is transmitted to the winding shaft gear 158 and the grid roller gear 186, and the winding shaft gear 158 and the grid roller gear 186 rotate. As a result, the winding shaft 116 and the grid roller 124 rotate. When these winding shaft 116 and grid roller 124 rotate, the wiping web 110 is thereby unwound from an unwinding core 138 which is mounted on the unwinding shaft 114, passes through a predetermined traveling path, and is wound into a winding core 142 which is mounted on the winding shaft 116.

Thus, when the wiping unit 100 is mounted on the wiping unit mounting portion 104, the rotation transmission gear 188 is engaged with the driving gear 192, and the winding shaft 116 and the grid roller 124 are enabled to be driven.

In addition, as illustrated in FIG. 5 to FIG. 7, the nozzle face cleaning device 64 is provided with a cleaning liquid adding nozzle 300 (cleaning liquid adding means) which adds the cleaning liquid to the wiping web 110. The wiping web 110 to which the cleaning liquid has been added wipes the nozzle face 30, and thereby the nozzle face 30 can be cleaned. The cleaning liquid adding nozzle 300 is fixed to the side face of the case 112 which forms the wiping unit 100, by a fixing plate 302, and is integrally formed with the case 112. The cleaning liquid adding nozzle 300 is provided in the upper part of the wiping unit 100, and adds the cleaning liquid to the wiping web 110 by dripping the cleaning liquid onto the wiping unit 100 from the cleaning liquid adding nozzle 300.

Figure 8:
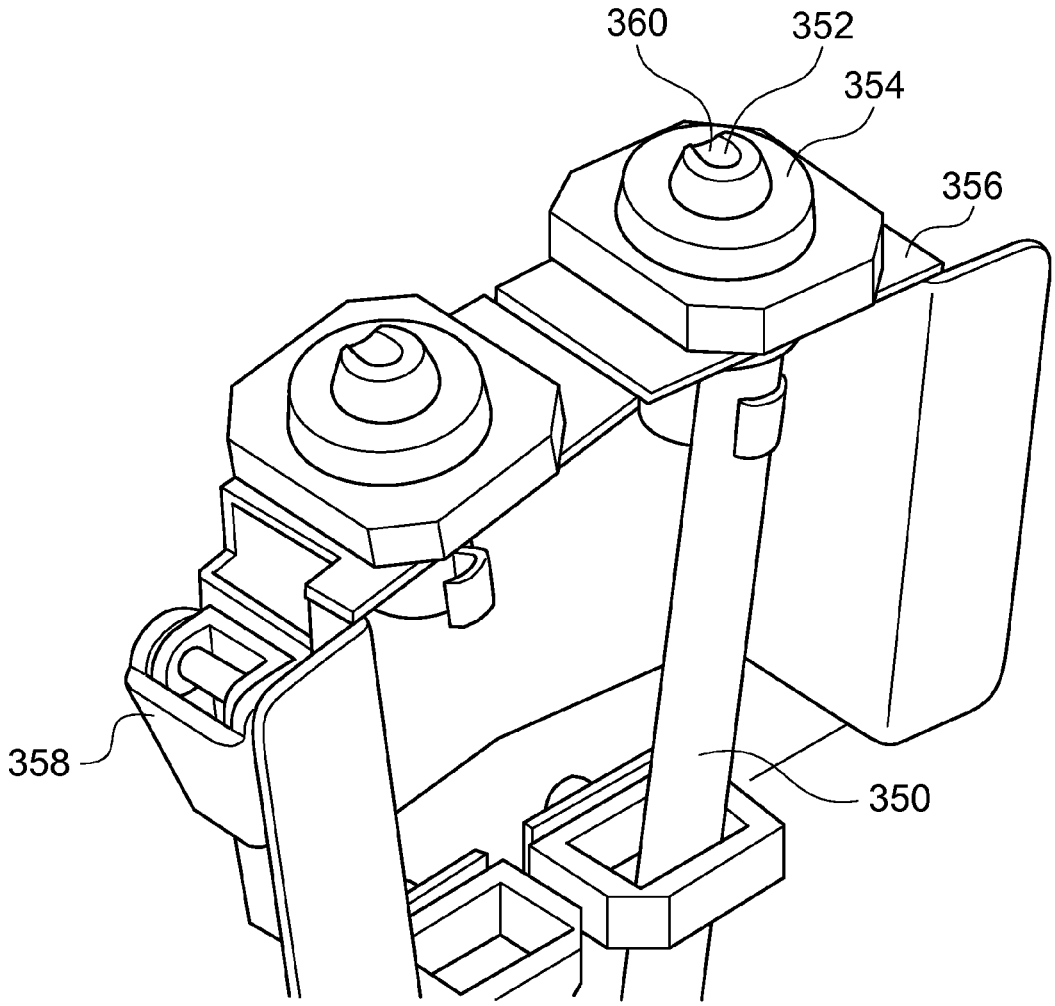
FIG. 8 is a perspective view of a cleaning liquid supply flow channel.

The cleaning liquid adding nozzle 300 is provided with a hole 304 for a cleaning liquid flow channel, into which a cleaning liquid supply flow channel 350 illustrated in FIG. 8 enters. When the cleaning liquid supply flow channel 350 is passed in the hole 304 for the cleaning liquid flow channel, the cleaning liquid supply flow channel 350 can supply the cleaning liquid to the cleaning liquid adding nozzle 300.

The cleaning liquid can be supplied from a tank (not illustrated) which stores the cleaning liquid therein with the use of a pump, a water head difference or the like, but is preferably supplied with the use of the water head difference, in particular. When the cleaning liquid is supplied with the use of the water head difference, the cleaning liquid can be supplied by the opening and closing of a solenoid valve (not illustrated). In addition, the pump does not need to be used for supplying the cleaning liquid, accordingly the device can be miniaturized, and the device can be kept clean.

In addition, when the cleaning liquid is supplied by the opening and closing of the solenoid valve with the use of the water head difference, the supply can be controlled by ON/OFF so as to match the supply timing of the cleaning liquid, and the supply amount can be controlled. Thereby, the nozzle face can be wiped with a necessary amount of the cleaning liquid, and accordingly the amount of a cleaning liquid to be consumed can be reduced.

The cleaning liquid which has been supplied to the cleaning liquid adding nozzle 300 passes on the cleaning liquid adding nozzle 300, and is dripped onto the wiping web 110 from the tip of the cleaning liquid adding nozzle 300. Thus, the cleaning liquid is supplied to the wiping web 110.

The tip of the cleaning liquid adding nozzle 300 is provided at the position in the upstream side of the second pre-stage guide 162 of the wiping unit 100 in the conveyance direction for the wiping web 110. The cleaning liquid which is dripped from the cleaning liquid adding nozzle 300 is added to the wiping web 110 before the wiping web 110 passes through the second pre-stage guide 162. In addition, the tip of the cleaning liquid adding nozzle 300 is arranged in the upper side of the tilt of the first pre-stage guide 160 and the second pre-stage guide 162, in the width direction of the conveyance direction of the wiping web 110. When the tip of the cleaning liquid adding nozzle 300 is arranged in such a position, the cleaning liquid which has been added to the wiping web 110 thereby spreads in the width direction of the wiping web 110 which is conveyed while being tilted along the tilt of the second pre-stage guide 162, and can be added to the whole surface in the width direction of the wiping web 110.

Incidentally, the position in the width direction of the wiping web 110 of the tip of the cleaning liquid adding nozzle 300 is not limited to the above described position in particular, and the cleaning liquid nozzle can also be structured so as to add the cleaning liquid to the whole surface in the width direction of the wiping web 110.

In addition, the present embodiment has been described so as to have such a form that the cleaning liquid adding nozzle 300 drips the cleaning liquid onto the wiping web 110, and thereby directly adds the cleaning liquid to the wiping web 110, but is not limited to this form, and may have such a form that the cleaning liquid is dropped from the cleaning liquid adding nozzle 300 onto the second pre-stage guide 162, and this second pre-stage guide 162 spreads the cleaning liquid to and indirectly adds the cleaning liquid to the whole surface in the width direction of the wiping web 110.

In addition, in the present embodiment, the cleaning liquid adding nozzle 300 is integrally formed with the case 112, and accordingly the cleaning liquid can be reliably added to a predetermined position of the wiping web 110. In addition, the cleaning liquid is dripped from the cleaning liquid adding nozzle 300, thereby the cleaning liquid can be added to the wiping web 110, and accordingly a distance between the wiping web 110 and the cleaning liquid adding nozzle 300 can be shortened. Accordingly, the cleaning liquid can be reliably added to a predetermined position, and the amount of the cleaning liquid to be used can be reduced. When the cleaning liquid is added with the use of a conventional spray or the like, there are cases where a distance between a spray nozzle and the wiping web is large, and the cleaning liquid is not added to a predetermined position by being sprayed, and there has been the case where the amount of the cleaning liquid increases as a whole. In the present embodiment, the cleaning liquid can be reliably added to the predetermined position of the wiping web 110 by the dripping method, and accordingly the amount of the cleaning liquid to be consumed can be reduced.

Figure 9:
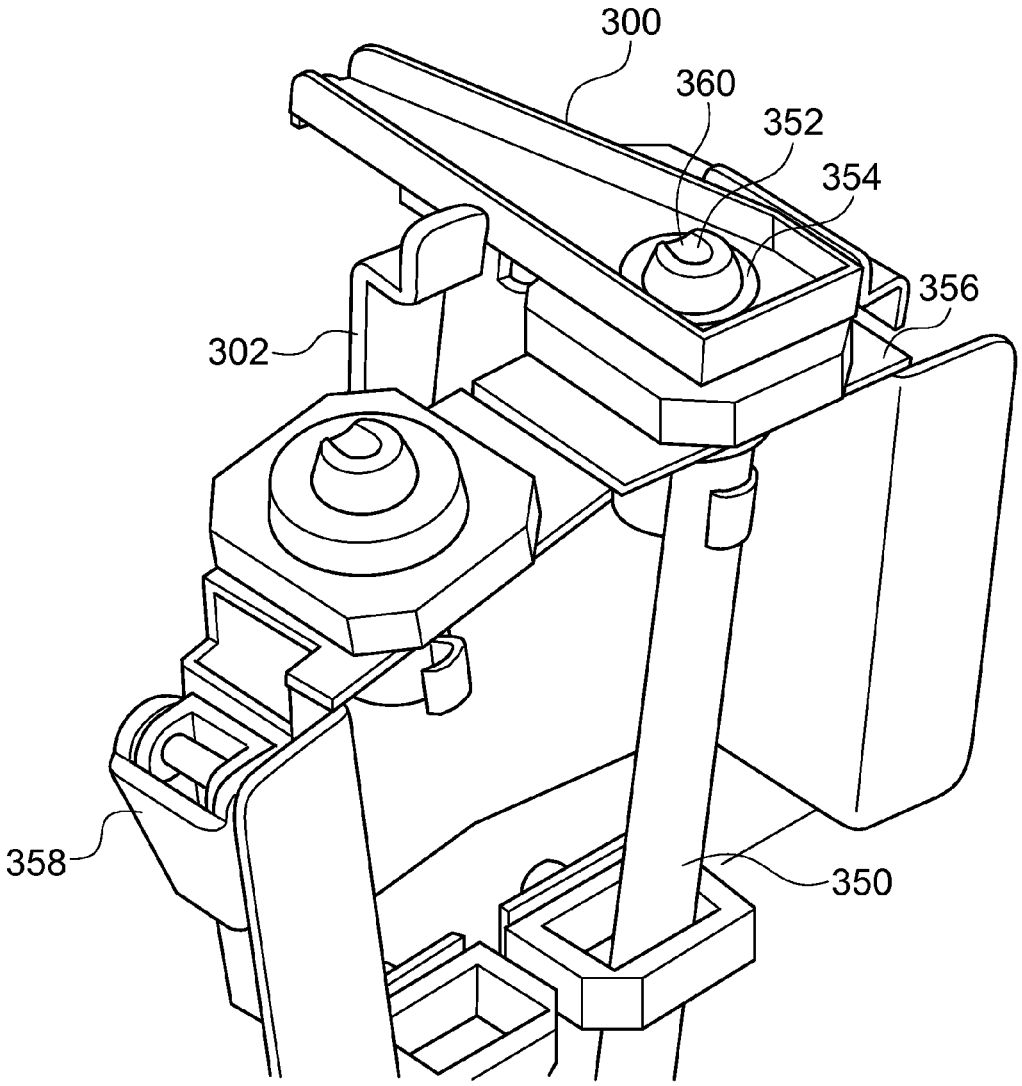
FIG. 9 is a perspective view of a state in which the cleaning liquid supply flow channel is fixed to a cleaning liquid adding nozzle.
Figure 10:
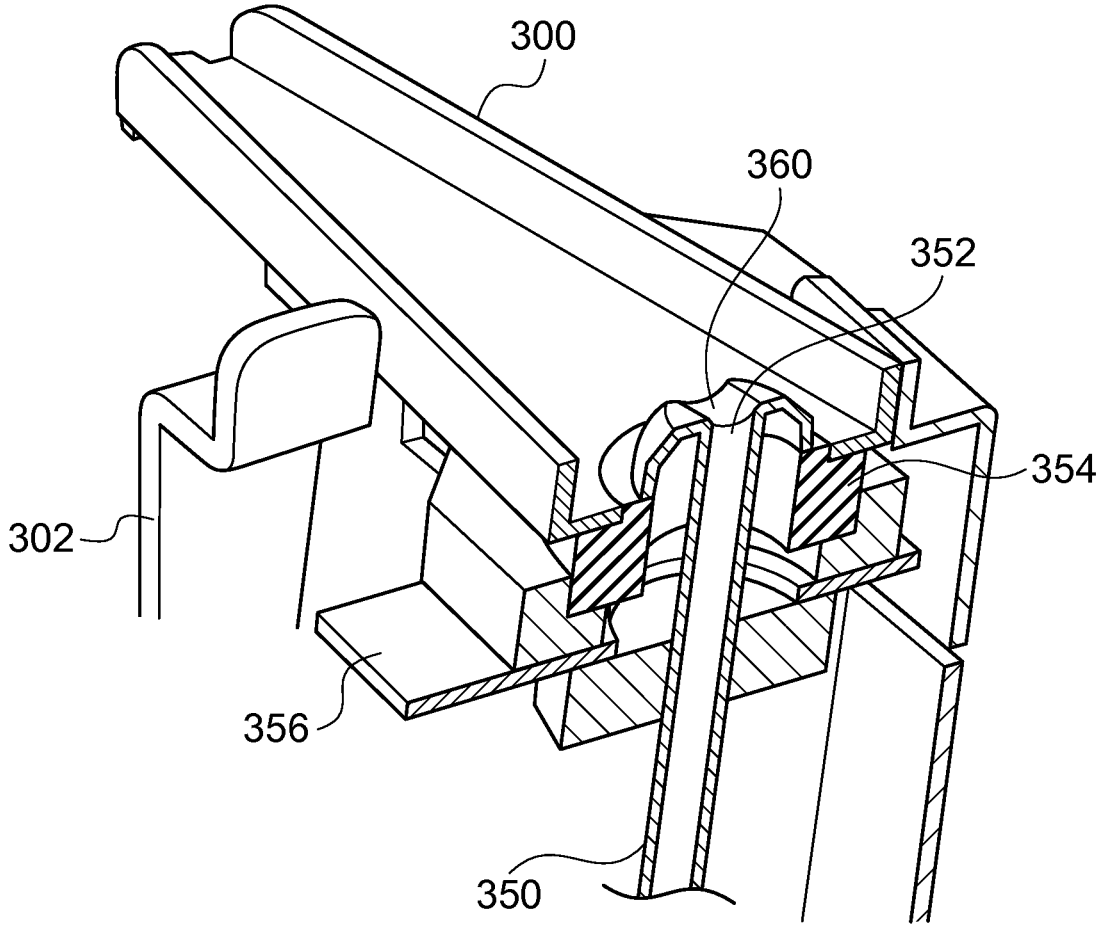
FIG. 10 is a sectional view illustrating a state in which the cleaning liquid supply flow channel is fixed to the cleaning liquid adding nozzle.
Figure 11A:
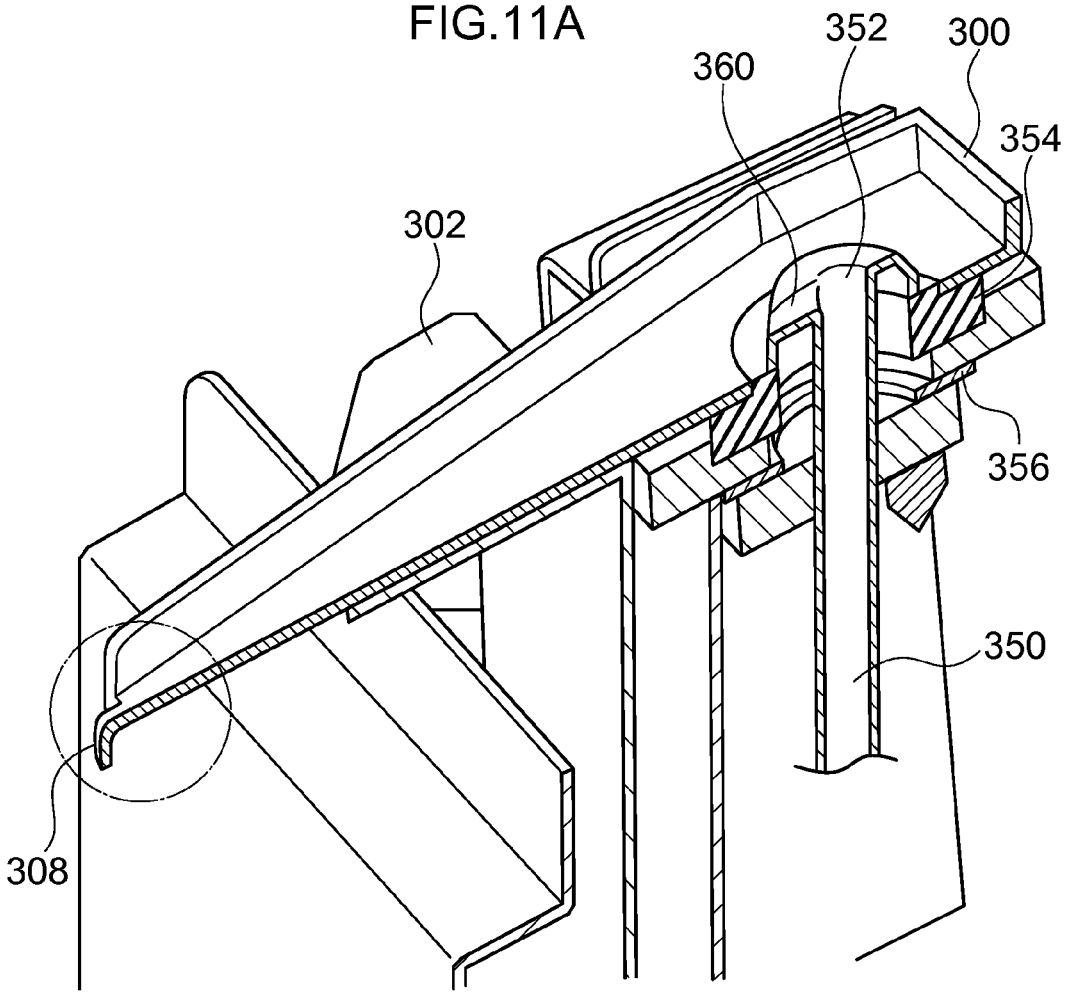
FIG. 11A is a sectional view illustrating a state in which the cleaning liquid supply flow channel is fixed to the cleaning liquid adding nozzle.
Figure 11B:
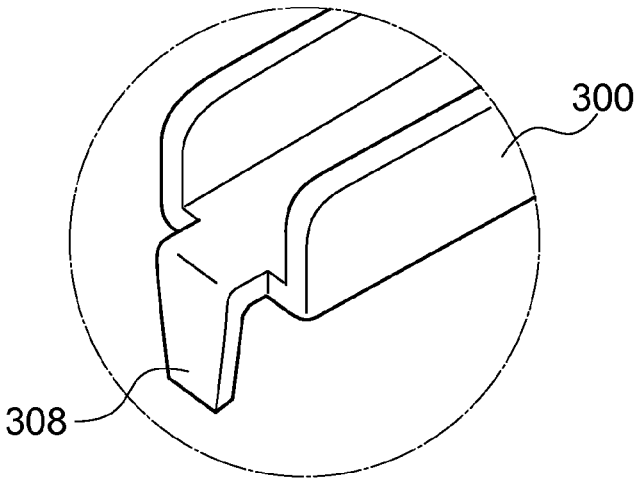
FIG. 11B is a view illustrating an embodiment of a tip part of the cleaning liquid adding nozzle.

FIG. 8 is a perspective view of the cleaning liquid supply flow channel 350, FIG. 9 is a view in which the cleaning liquid adding nozzle 300 is mounted on the cleaning liquid supply flow channel 350, and FIG. 10, FIG. 11A and FIG. 11B are sectional views of the cleaning liquid supply flow channel 350. Incidentally, in FIG. 8 and FIG. 9, the right side in each of the figures shows a state in which the cleaning liquid supply flow channel 350 and the cleaning liquid adding nozzle 300 are fixed, and the left side shows a state in which the cleaning liquid supply flow channel 350 and the cleaning liquid adding nozzle 300 are not fixed. The cleaning liquid adding nozzle is provided in each of the wiping units 100C, 100M, 100Y and 100K, and the cleaning liquid supply flow channel is provided correspondingly in each of the cleaning liquid adding nozzles.

As is illustrated in the figures, in the cleaning liquid supply flow channel 350, an outlet 352 of the cleaning liquid supply flow channel 350 is opened to the air. The cleaning liquid which has passed through the cleaning liquid supply flow channel 350 and has been discharged from the outlet 352 of the cleaning liquid supply flow channel 350 passes on the cleaning liquid adding nozzle 300, and is dripped onto the wiping web 110.

In the present embodiment, the cleaning liquid adding nozzle 300 and the cleaning liquid supply flow channel 350 are formed into an attachable/detachable type. The cleaning liquid adding nozzle 300 and the cleaning liquid supply flow channel 350 are coupled to each other, by making the cleaning liquid supply flow channel 350 enter into the hole 304 for the cleaning liquid flow channel, which is provided on the cleaning liquid adding nozzle 300, from the lower part. In addition, the coupled portion (connected portion) of the cleaning liquid adding nozzle 300 with the cleaning liquid supply flow channel 350 is provided with a rubber seal member 354. This rubber seal member 354 seals the hole 304 for the cleaning liquid flow channel, adheres to and is fixed at the hole 304; and accordingly can prevent a leakage of the liquid. Thus, the cleaning liquid can be efficiently supplied to the wiping member.

As for a method of fixing the cleaning liquid adding nozzle 300 and the cleaning liquid supply flow channel 350, a hook 306 which is provided on the side part of the cleaning liquid adding nozzle 300 is engaged with a hook 358 which is provided on the side part of a supply flow channel fixing base plate 356 for fixing the cleaning liquid supply flow channel 350 (where the hook 358 is drawn only on the side of the cleaning liquid supply flow channel 350 in which the cleaning liquid adding nozzle 300 is not fixed in FIG. 8 and FIG. 9, but the hook 358 is provided also on the side in which the cleaning liquid adding nozzle 300 is fixed), and thereby the cleaning liquid adding nozzle 300 and the cleaning liquid supply flow channel 350 are fixed.

FIG. 10, FIG. 11A and FIG. 11B are sectional views of the cleaning liquid adding nozzle 300 and the cleaning liquid supply flow channel 350. As is illustrated in FIG. 10, FIG. 11A and FIG. 11B, the cleaning liquid supply flow channel 350 is opened to the air, on the cleaning liquid adding nozzle 300. When the outlet 352 of the cleaning liquid supply flow channel 350 is opened to the air, and when the cleaning liquid supply flow channel 350 and the cleaning liquid adding nozzle 300 can be attached to and detached from each other, as in the above way, the mixing of the air into the cleaning liquid supply flow channel 350 can be prevented. When the cleaning liquid is added with the use of the spray, as in a conventional way, it occasionally occurs that the air is mixed into the cleaning liquid supply flow channel when the spray is detached from the cleaning liquid supply flow channel. There has been a problem that when the cleaning liquid is added by the spray method in the state in which the air is mixed into the cleaning liquid supply flow channel, the amount of the cleaning liquid is not stable in an early period of the time when the cleaning liquid has been added. The cleaning device in the present embodiment can prevent the air from mixing into the cleaning liquid supply flow channel 350, even when having replaced the cleaning liquid adding nozzle 300, and can stably supply the cleaning liquid to the wiping web 110.

In addition, as has been described above, the cleaning liquid adding nozzle 300 is integrated with the case 112, and can be attached to and detached from the cleaning liquid supply flow channel 350. Thereby the cleaning liquid supply flow channel 350 can be easily detached. Accordingly, when the wiping web 110 which has been used for wiping is replaced, complicated assembly is not needed, and the wiping web 110 can be easily replaced.

Furthermore, as is illustrated in FIG. 11A and FIG. 11B, the portion of the outlet 352 of the cleaning liquid supply flow channel 350 is formed into a pedestal structure which projects upward from the hole 304 for the cleaning liquid flow channel of the cleaning liquid adding nozzle 300, and it is preferable that a part of this pedestal structure has a cutout portion 360 in the side of the direction in which the cleaning liquid adding nozzle 300 drips the cleaning liquid onto the wiping web 110. The cleaning liquid adding nozzle 300 has the cutout portion 360 in the outlet 352 of the cleaning liquid supply flow channel 350, and thereby can facilitate the cleaning liquid to flow in a predetermined direction. In addition, it is preferable that a tip 308 of the cleaning liquid adding nozzle 300 is bent to the side of the wiping web 110 so that a predetermined amount of the cleaning liquid can be exactly dripped onto a fixed position from the tip. Due to the structure that the tip 308 of the cleaning liquid adding nozzle 300 is bent to the side of the wiping web 110, the cleaning liquid can be dripped from the bent tip 308, and the cleaning liquid can be supplied to a fixed position.

Figure 12A:
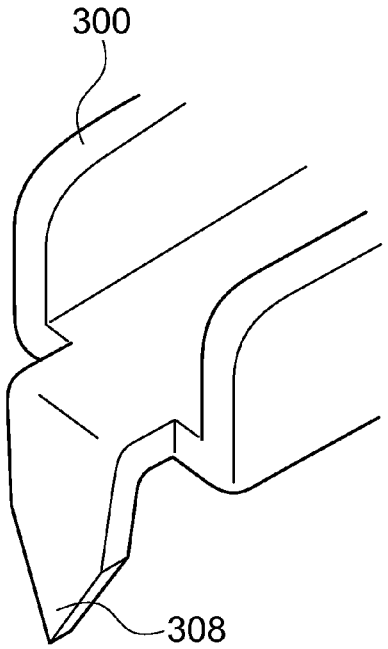
FIG. 12A is a view illustrating other embodiment of the tip part of the cleaning liquid adding nozzle.
Figure 12B:
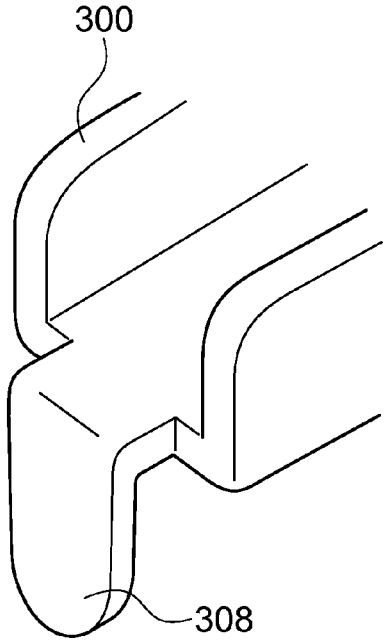
FIG. 12B is a view illustrating other embodiment of the tip part of the cleaning liquid adding nozzle.

In addition, it is preferable that in order that the tip 308 of the cleaning liquid adding nozzle 300 has adequate dripping properties, the angle is set at an acute angle as is illustrated in FIG. 12A, or is set at a semicircle having the curvature radius R of 1 cm or smaller, as is illustrated in FIG. 12B. When the tip is formed so as to have such a shape, the dripping properties from the tip can be made adequate.

Furthermore, it is preferable that the material of the cleaning liquid adding nozzle 300 is formed from a material having adequate dripping properties (water-repellent material) or is coated with the material having adequate dripping properties. Thereby, the cleaning liquid does not stay on the cleaning liquid adding nozzle 300, and the cleaning liquid is enabled to easily flow. The material to be coated thereon can include fluororesin coating and the like.

(Other Embodiment)

In the above described embodiment, the nozzle face cleaning device has been described in which the pressing roller is tilted so as to match the tilt of the nozzle face of the ink jet head, but the present invention is not limited to the nozzle face cleaning device. The present invention can be applied also to a nozzle face cleaning device in which the pressing roller is horizontally provided so as to match the nozzle face of the horizontal head. In this case, it is preferable that the cleaning liquid adding nozzle is arranged so as to be capable of adding the cleaning liquid to the whole region in the width direction of the wiping web.

In addition, as for the wiping method, the cleaning device in the above described embodiment cleans the nozzle face by making the ink jet head move and also the wiping web travel, but it is also possible to wipe and clean the nozzle face by pressing the wiping web to the whole surface of the nozzle face and making only the wiping web travel, without making the ink jet head move. When the ink jet head is not moved, the wiping member travel driving means becomes wiping means, which includes the unwinding shaft 114, the winding shaft 116 and the grid roller 124.

Furthermore, the ink jet head is not limited to a line head in which a plurality of nozzles are arranged over a length corresponding to a full width of the recording medium, but can be applied also to a serial head in which the head reciprocally moves in a direction perpendicular to the conveyance direction of a recording medium.

What is claimed is:

1. A nozzle face cleaning device configured to clean a nozzle face of an ejection head comprising:

a wiping member which has a long shape and water absorbing properties;

a cleaning liquid adding unit configured to add a cleaning liquid to the wiping member to bring the wiping member to a wet state by the cleaning liquid in an amount suitable for wiping the ejection head;

a pressing unit configured to make the wiping member to which the cleaning liquid has been added abut on and pressed against the nozzle face; and a wiping unit that has a wiping member travel driving unit configured to make the wiping member travel in a longitudinal direction along a predetermined conveyance path, the wiping unit configured to wipe the nozzle face with the wiping member to which the cleaning liquid has been added, by relatively moving the wiping member and the ejection head so that the wiping member which has been made abut on and pressed against the nozzle face slides along the nozzle face while being travelled by the wiping member travel driving unit, wherein the cleaning liquid adding unit includes a cleaning liquid supply flow channel, and a cleaning liquid adding nozzle which is detachably connected to the cleaning liquid supply flow channel and adds the cleaning liquid to the wiping member therethrough, the cleaning liquid adding nozzle is provided in a case in which the wiping member, the wiping member travel driving unit and the pressing unit are integrated, the cleaning liquid supply flow channel is opened to the air in a connected portion of the cleaning liquid supply flow channel with the cleaning liquid adding nozzle, a surface of the cleaning liquid adding nozzle is formed from a water-repellent material, a position at which the cleaning liquid is added to the wiping member from the cleaning liquid adding nozzle is provided in an upper side in a vertical direction of the wiping member, and the cleaning liquid is added to the wiping member by the dripping of the cleaning liquid from the cleaning liquid adding nozzle.

2. The nozzle face cleaning device according to claim 1, wherein the cleaning liquid supply flow channel has a cutout portion in a portion at which the cleaning liquid supply flow channel is opened to the air.

3. The nozzle face cleaning device according to claim 1, wherein the cleaning liquid supply flow channel and the cleaning liquid adding nozzle are connected to each other through a rubber seal member.

4. The nozzle face cleaning device according to claim 1, wherein a tip portion of the cleaning liquid adding nozzle has a bent shape.

5. The nozzle face cleaning device according to claim 4, wherein a shape of the tip portion of the cleaning liquid adding nozzle is an acute angle.

6. The nozzle face cleaning device according to claim 4, wherein a shape of the tip portion of the cleaning liquid adding nozzle is a semicircular shape of which the curvature radius R is 1 cm or smaller.

7. The nozzle face cleaning device according to claim 1, wherein the nozzle face is arranged so as to be tilted against a horizontal plane, and the pressing unit is arranged so as to be tilted so as to correspond to the nozzle face.

8. The nozzle face cleaning device according to claim 7, wherein a position at which the cleaning liquid is added to the wiping member from the cleaning liquid adding nozzle is provided in an upper side of tilt.

9. The nozzle face cleaning device according to claim 1, wherein the cleaning liquid is supplied to the cleaning liquid adding nozzle by water head difference.

10. An image recording device comprising:

a conveyance unit configured to convey a recording medium;

a droplet ejection head configured to eject an ink droplet onto a recording medium which is conveyed by the conveyance unit to form an image; and the nozzle face cleaning device according to claim 1, which cleans the nozzle face of the droplet ejection head.

11. The nozzle face cleaning device according to claim 1, wherein the cleaning liquid adding nozzle is fixed to a side face of the case through a fixing plate so as to be integrally formed with the case.

* * * * *